US009532134B2

(12) United States Patent
Hosoe et al.

(10) Patent No.: US 9,532,134 B2
(45) Date of Patent: Dec. 27, 2016

(54) SOUND PICKUP APPARATUS

(75) Inventors: Seiichiro Hosoe, Hamamatsu (JP); Yuichiro Suenaga, Hamamatsu (JP); Satoshi Ukai, Hamamatsu (JP); Ryo Oouchi, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 433 days.

(21) Appl. No.: 13/148,633

(22) PCT Filed: Feb. 10, 2010

(86) PCT No.: PCT/JP2010/051951

§ 371 (c)(1),
(2), (4) Date: Aug. 9, 2011

(87) PCT Pub. No.: WO2010/092975

PCT Pub. Date: Aug. 19, 2010

(65) Prior Publication Data

US 2011/0317862 A1 Dec. 29, 2011

(30) Foreign Application Priority Data

Feb. 10, 2009 (JP) ..... 2009-028609

(51) Int. Cl.
*H04R 9/08* (2006.01)
*H04R 9/04* (2006.01)
*H04R 1/40* (2006.01)

(52) U.S. Cl.
CPC ..... *H04R 1/406* (2013.01)

(58) Field of Classification Search
CPC ..... H04R 9/08
(Continued)

(56) References Cited

U.S. PATENT DOCUMENTS

2005/0058300 A1* 3/2005 Suzuki et al. ..... 381/92
2005/0084121 A1* 4/2005 Muren et al. ..... 381/171
(Continued)

FOREIGN PATENT DOCUMENTS

CN 2497501 Y 6/2002
CN 101099409 A 1/2008
(Continued)

OTHER PUBLICATIONS

International Search Report cited in International Application No. PCT/JP2010/051951, dated Jul. 6, 2010.
(Continued)

*Primary Examiner* — Matthew Eason
*Assistant Examiner* — Phan Le
(74) *Attorney, Agent, or Firm* — Rossi, Kimms & McDowell LLP

(57) ABSTRACT

A sound pickup apparatus, which can control directionality and has a simple structure, and in which a plurality of microphones can be provided so as to be floated by using the small number of parts, is provided. Three support columns 13A to 13C having the same length are provided upright on a top surface of a housing 11 of a sound pickup apparatus 1. The support columns 13A to 13C are equidistantly arranged away from a center position of the housing 11 and equally spaced 120 degrees apart from each other. A frame 4 having microphone frames 14A to 14C in which microphones are fitted is arranged above the top surface of the housing 11. In addition, the microphone frames 14A to 14C are coupled to the support columns 13A to 13C of the housing 11 by elastic rubbers 15A to 15C in a state where tensile stress passes the center of the housing 11 and is generated in an outward direction.

15 Claims, 7 Drawing Sheets

(58) Field of Classification Search
USPC ..... 381/356.361; 379/356
See application file for complete search history.

(56) References Cited

U.S. PATENT DOCUMENTS

| | | | | |
|---|---|---|---|---|
| 2006/0088173 | A1 | 4/2006 | Rodman et al. | |
| 2007/0009116 | A1* | 1/2007 | Reining | 381/122 |
| 2007/0165877 | A1* | 7/2007 | Schmidt et al. | 381/87 |
| 2007/0195983 | A1* | 8/2007 | Klemme | 381/362 |
| 2008/0019551 | A1 | 1/2008 | Watanabe | |
| 2008/0144876 | A1* | 6/2008 | Reining et al. | 381/369 |
| 2009/0279730 | A1* | 11/2009 | Sank | H04R 11/04 381/368 |
| 2010/0086124 | A1* | 4/2010 | Downing et al. | 379/433.03 |
| 2010/0166212 | A1 | 7/2010 | Ishibashi et al. | |
| 2012/0281854 | A1 | 11/2012 | Ishibashi et al. | |

FOREIGN PATENT DOCUMENTS

| | | | |
|---|---|---|---|
| CN | 101331793 | A | 12/2008 |
| EP | 1 651 001 | A2 | 4/2006 |
| JP | 56-77190 | A | 6/1981 |
| JP | 58-50786 | A | 4/1983 |
| JP | 59-180583 | A | 12/1984 |
| JP | 63-56895 | A | 4/1988 |
| JP | 1-064284 | A | 4/1989 |
| JP | 1-65583 | A | 4/1989 |
| JP | 2000-152360 | | 5/2000 |
| JP | 2000-004494 | | 7/2000 |
| JP | 2002-204491 | | 7/2002 |
| JP | 3331312 | | 7/2002 |
| JP | 2004-304263 | | 10/2004 |
| JP | 2005-057398 | | 3/2005 |
| JP | 3896546 | | 1/2007 |
| JP | 2007-174271 | | 7/2007 |
| JP | 2008-177802 | A | 7/2008 |

OTHER PUBLICATIONS

Notification of the First Office Action for corresponding CN 201080006685.0, dated Jul. 1, 2013. English translation provided.

* cited by examiner

SOUND PICKUP APPARATUS

This application is a U.S. National Phase Application of PCT International Application PCT/JP2010/051951 filed on Feb. 10, 2010 which is based on and claims priority from JP 2009-028609 filed on Feb. 10, 2009 the contents of which is incorporated herein in its entirety by reference.

TECHNICAL FIELD

The present invention relates to a sound pickup apparatus having a plurality of microphones.

BACKGROUND ART

Conventionally, a variety of sound pickup apparatuses in which a microphone is swingably provided (floating mechanism) without being fixed to a housing so as not to transmit an influence of vibration of the housing caused by a pushing of a button and so on, to the microphone, have been suggested (for example, refer to Patent Documents 1 to 3).

In a structure of a microphone unit disclosed in Patent Document 1, the microphone unit is floated by using a magnetic member.

In an electret condenser microphone disclosed in Patent Document 2, a wiring terminal of a microphone unit is contacted by using a coil or elastic member, thereby floating the microphone unit.

In a microphone apparatus embedded in a device disclosed in Patent Document 3, a substrate on which a plurality of microphones are mounted is surrounded by an elastic member, thereby floating the microphones.

RELATED ART DOCUMENTS

Patent Documents

Patent Document 1: JP-B-3896546
Patent Document 2: JP-B-3331312
Patent Document 3: JP-A-2000-004494

SUMMARY OF THE INVENTION

Problems to be Solved

However, according to the holding structure of the microphone unit disclosed in Patent Document 1, when a diaphragm of the microphone is made of a material susceptible to magnetic force, a characteristic of the microphone may be deteriorated due to the magnetic member.

According to the electret condenser microphone disclosed in Patent Document 2, a structure thereof is complicated and the elastic member is aging-deteriorated, so that the wiring terminal of the microphone unit may be poorly connected.

According to the microphone apparatus embedded in a device disclosed in Patent Document 3, since the elastic member entirely surrounds the substrate having the plurality of microphones mounted thereon, the cost is high.

Accordingly, an object of the invention is to provide a sound pickup apparatus that has a simple structure and a plurality of microphones that can be provided so as to floated using the small number of parts.

Means for Solving the Problem

According to the present invention, there is provided a sound pickup apparatus comprising:

a housing;

a frame that fixes a plurality of microphones;

a plurality of support parts that is provided on the housing so as to surround the frame; and a plurality of elastic members that couples the frame with the support parts respectively in a state that the frame and the housing are spaced to each other.

Preferably, the frame has a plurality of microphone frames which fix the microphones respectively so that directional axes of the microphones are not consistent to each other and the microphones are spaced apart from each other at an equal angle on a same circumference of a circle.

Preferably, the frame has a plurality of joint parts, and the elastic members are attached to the joint parts respectively.

Preferably, the joint parts are provided on the microphone frames, respectively.

Preferably, the frame has a shape of rotational symmetry, the joint parts are arranged so as to be spaced apart from each other at an equal angle on a circumference of a circle having a center on a central axis of the rotation, and the support parts are arranged at the same angle as the joint parts on a circumference of a circle having a center on a central axis of the rotation and having a radius different from a radius of the circle in which the joint parts are arranged.

Preferably, the frame has a configuration that the microphone frames and the joint parts are integrally formed to each other.

Preferably, each of the elastic members has a length which is shorter than a distance between each support part and each joint part under no load.

Preferably, tensile stresses are applied to the elastic members in a state where the elastic members couple the frame with the support parts.

Preferably, directions of the tensile stresses applied to the elastic members and directions perpendicular to vibration planes of the nearest microphones corresponding to the respective elastic members are the same when seen from a plan view.

Preferably, the frame fixes the microphones so that maximum sensitivity directions of the microphones are directed in an inward direction of an arrangement of the microphones.

Preferably, the housing is a speaker enclosure, and a speaker is provided in the housing.

Advantageous Effects of Invention

According to the invention, the sound pickup apparatus has the plurality of microphones that can provided so as to be floated using the small number of parts without deteriorating the sound pickup performance.

DESCRIPTION OF EMBODIMENTS

Figure 1:
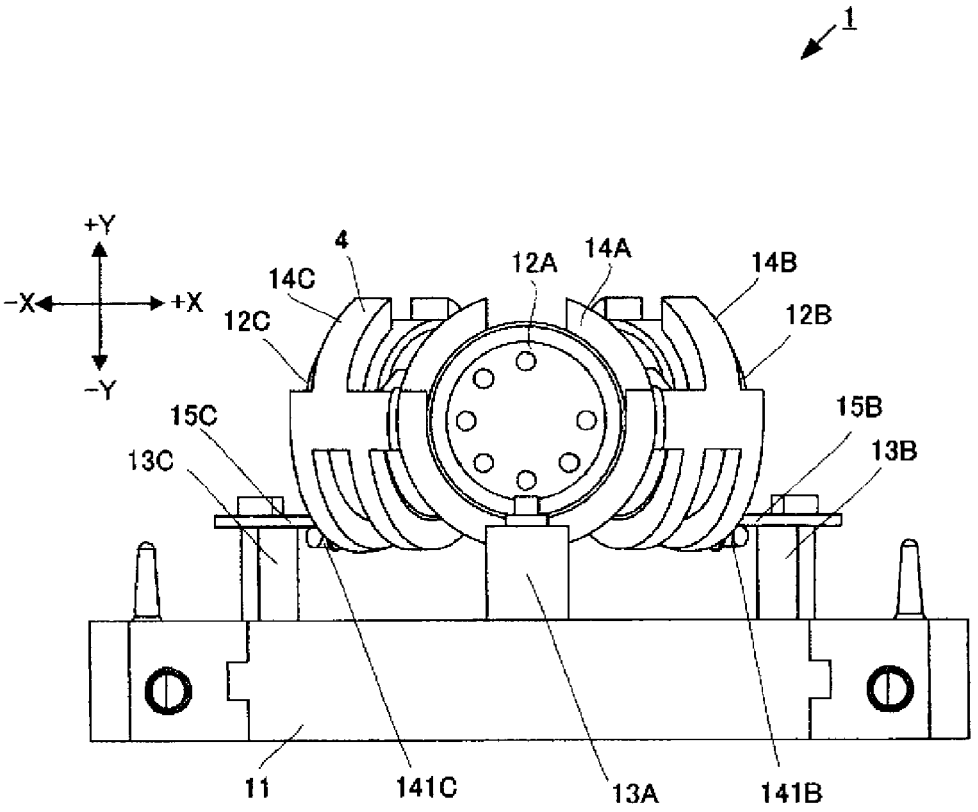
FIG. 1 is a front view of a sound pickup apparatus.
Figure 2:
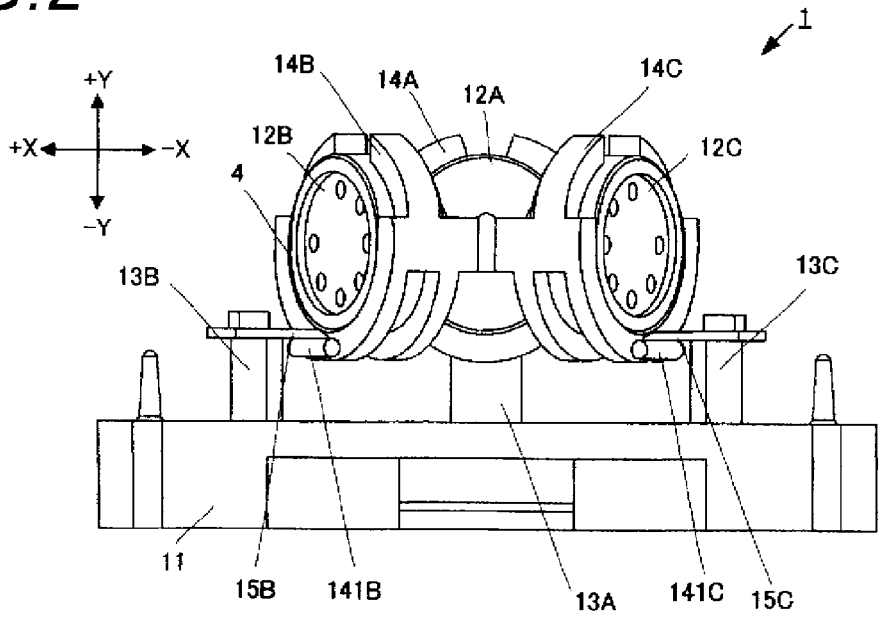
FIG. 2 is a rear view of the sound pickup apparatus.
Figure 3:
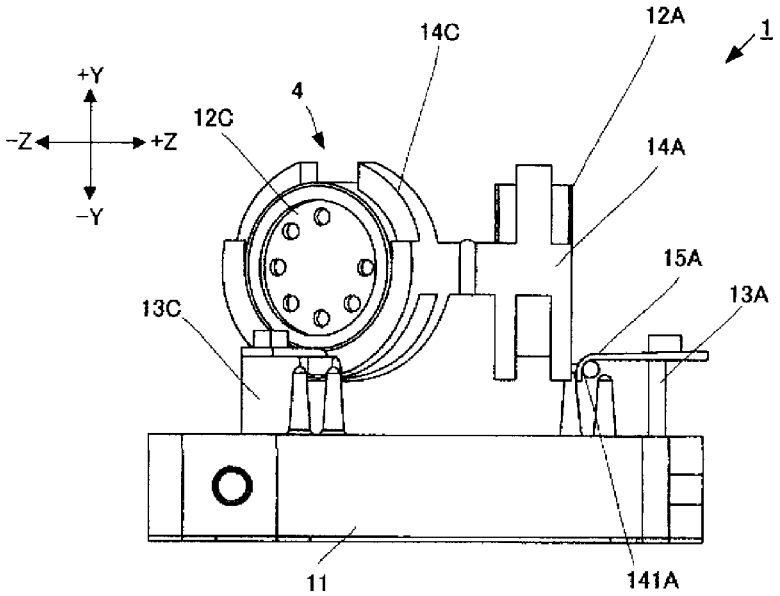
FIG. 3 is a left side view of the sound pickup apparatus.
Figure 4:
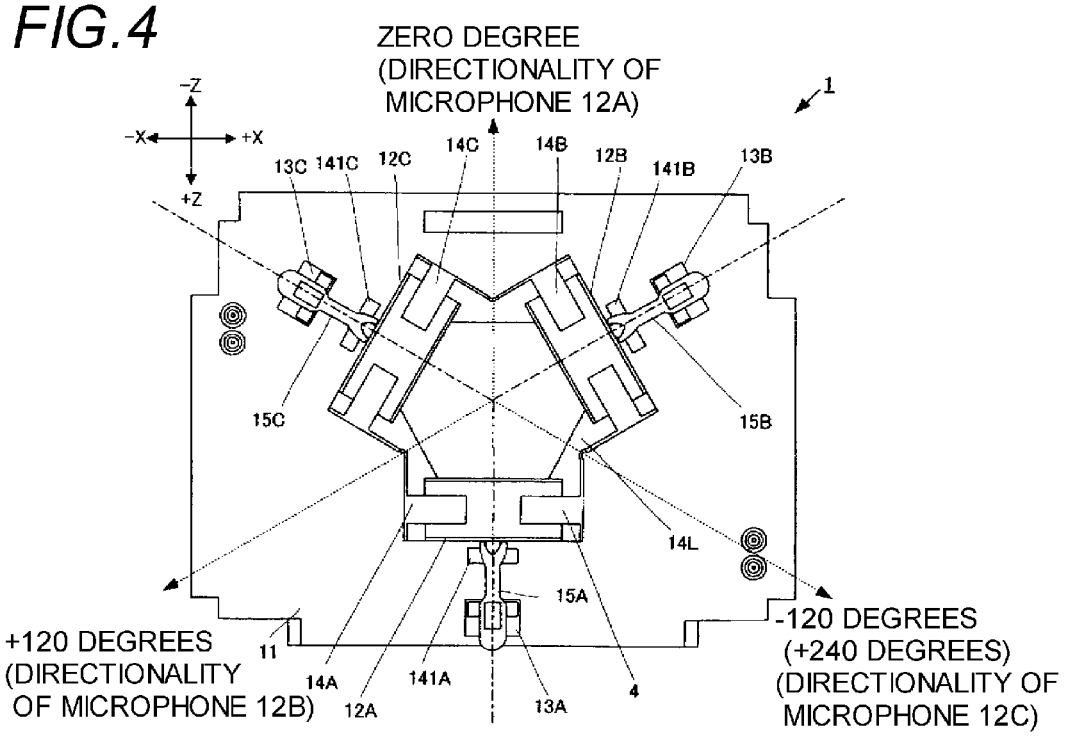
FIG. 4 is a plan view of the sound pickup apparatus.

An outward appearance of a sound pickup apparatus of an embodiment is described. FIGS. 1 to 4 show outward appearances of the sound pickup apparatus of this embodiment. FIG. 1 is a front view, FIG. 2 is a rear view, FIG. 3 is a left side view and FIG. 4 is a plan view. In FIGS. 1 to 4, a right direction of the sound pickup apparatus is referred to as +X, a left direction is referred to as −X, an upward direction is referred to as +Y, a downward direction is referred to as −Y, a front direction is referred to as +Z and a rear direction is referred to as −Z.

As shown in FIGS. 1 to 3, a sound pickup apparatus 1 has a flat plate-type housing 11 that serves as a basis, a frame 4 that integrally fixes a plurality of microphones, and elastic rubbers 15A, 15B, 15C that couple the frame 4 with the housing 11. Three support columns 13A, 13B, 13C having the same length are mounted upright on a top surface of the housing 11. The housing 11 and the support columns 13A, 13B, 13C are integrally formed of a resin material, for example. If the housing 11 and the support columns 13A, 13B, 13C are configured by separate parts, when vibration is spread between the housing 11 and the support columns 13A, 13B, 13C, new vibration is caused between the parts. However, since the housing and the support columns are integrally formed, such vibration is not caused.

As shown in the plan view of FIG. 4, the support columns 13A, 13B, 13C are equidistantly arranged away from a center position of the housing 11 and equally spaced 120 degrees apart from each other. When it is assumed that the support column 13A is attached to a position of the front direction (+Z direction) of the apparatus from the center position of the housing 11, the support column 13B is attached to a position of the right rear direction (+X, −Z direction) of the apparatus from the center position of the housing 11 and the support column 13C is attached to a position of the left rear direction (−X, −Z direction) of the apparatus from the center position of the housing 11.

As shown in FIGS. 1 to 4, the frame 4 that is arranged above the housing 11 has microphone frames 14A, 14B, 14C and joint parts 141A, 141B, 141C that are respectively provided on lower parts of the microphone frames 14A, 14B, 14C. The joint parts 141A, 141B, 141C and the microphone frames 14A, 14B, 14C are integrally formed. If the frame 4 has such a structure that the respective microphone frames and the joint parts are separately formed and assembled, separate vibrations are generated between the parts. However, since the microphone frames and the joint parts are integrally formed, such vibrations are not generated.

As shown in the plan view of FIG. 4, when seeing the sound pickup apparatus 1 from a plan view, the frame 4 has such a structure that the microphone frames 14A, 14B, 14C are equally spaced (equally spaced 120 degrees) apart from each other on a same circumference.

The microphone frames 14A, 14B, 14C have a cylindrical shape, respectively, and cylindrical microphones (unidirectional microphones) are fitted in hollow spaces thereof. The frame 4 integrally fixes the three microphones, which are fitted in the microphone frames, as one unit.

In addition, the joint parts 141A, 141B, 141C are formed at end portions of the microphone frames 14A, 14B, 14C. The end portions are arranged so as to be opposite to the center of the frame 4. The joint parts 141A, 141B, 141C are radially protruded, respectively. The joint parts 141A, 141B, 141C are connected to the support columns 13A, 13B, 13C of the housing 11 by flat elastic rubbers 15A, 15B, 15C, respectively.

The elastic rubbers 15A, 15B, 15C have the same elasticity and a length shorter than a distance between the support column and the joint part, respectively, under a state of no load. The elastic rubber 15A couples the support column 13A with the joint part 141A in a state where tensile stress passing the center of the housing 11 in a radial direction is generated. Likewise, the elastic rubber 15B couples the support column 13B with the joint part 141B in a state where tensile stress passing the center of the housing 11 in a radial direction is generated. In addition, the elastic rubber 15C couples the support column 13C with the joint part 141C in a state where tensile stress passing the center of the housing 11 in a radial direction is generated.

Figure 5:
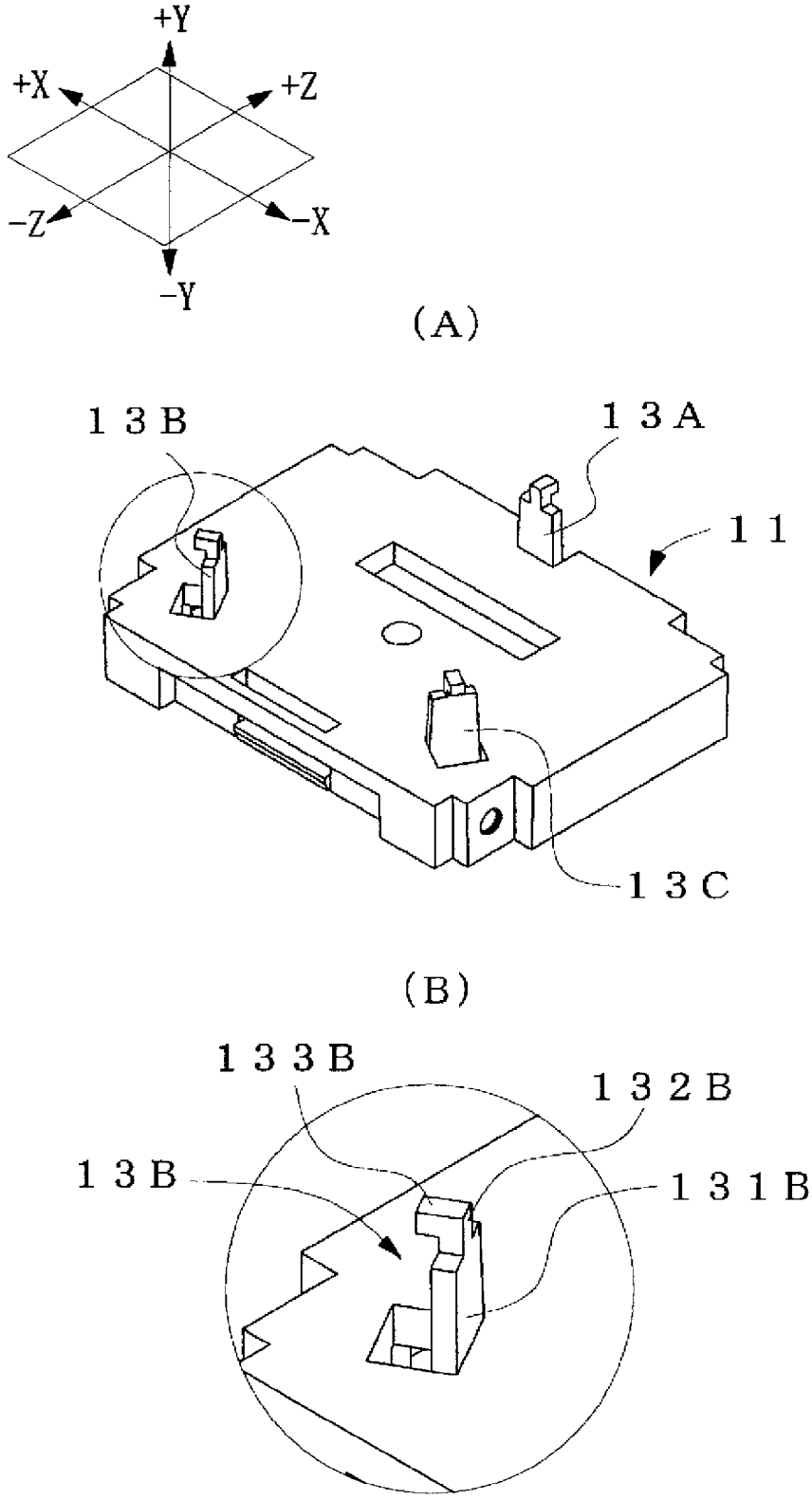
FIG. 5(A) is a view showing an outward appearance of a housing.
FIG. 5(B) is a partial enlarged view of the housing.
Figure 6:
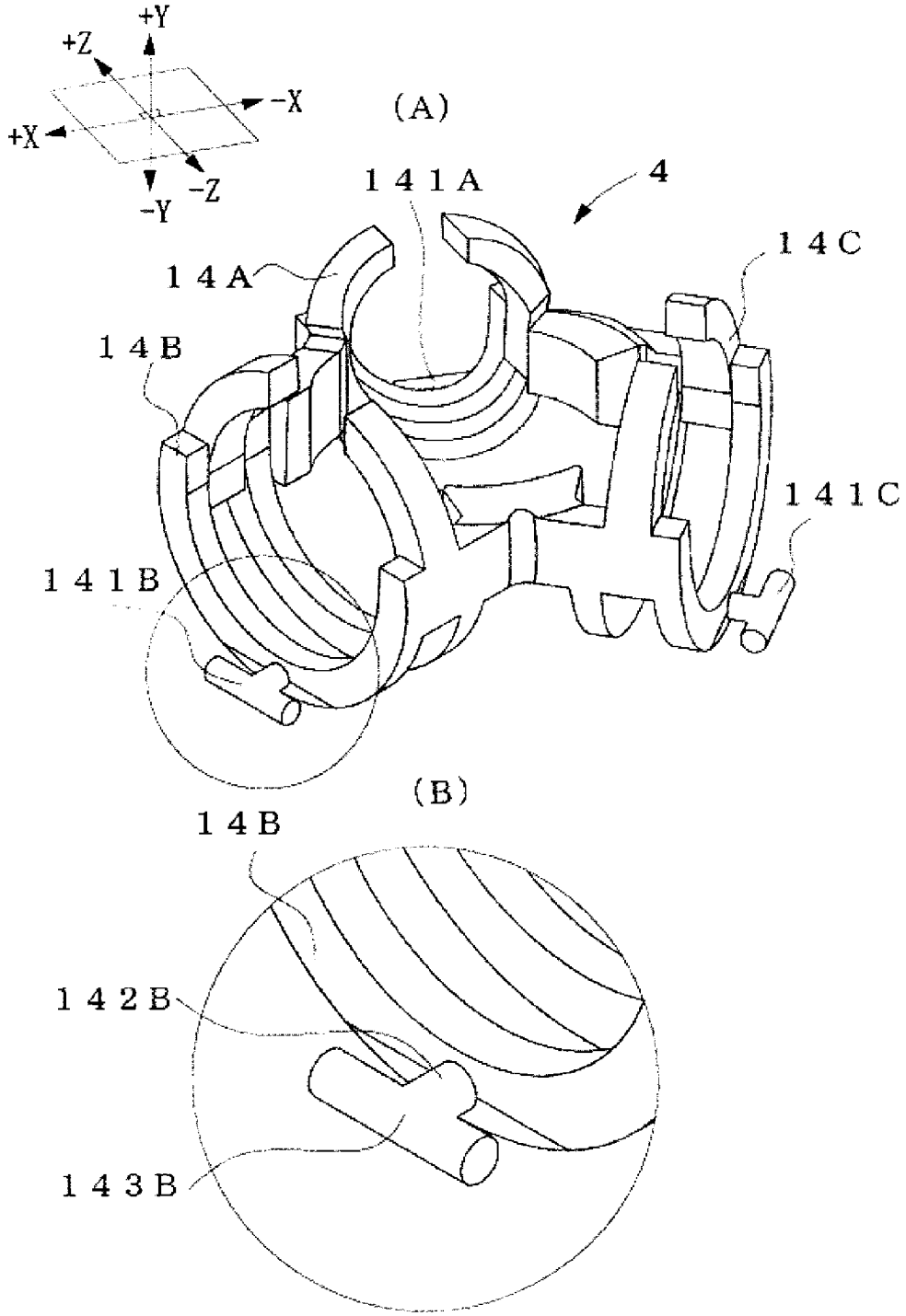
FIG. 6(A) is a view showing an outward appearance of a frame and FIG. 6(B) is a partial enlarged view of the frame.

Next, the structures of the housing 11, the frame 4 and the elastic rubbers 15A to 15C will be more specifically described with reference to FIGS. 5 to 7.

First, the shape of the support columns 13A to 13C provided to the housing 11 is described with reference to FIG. 5. FIG. 5 shows an outward appearance of the housing. FIG. 5(A) is a perspective view of the housing and FIG. 5(B) is a partial enlarged view of the housing. The support columns 13A to 13C provided to the housing 11 have the same shape. Thus, the support column 13B is exemplified in the below.

As shown in FIG. 5(B), the support column 13B has a main body portion 131B, an attaching portion 132B and a leading end portion 133B. The main body portion 131B has a rectangular parallelepiped shape protruding upright from the top surface of the housing 11 and the attaching portion 132B is provided to a leading end of the main body portion 131B. The attaching portion 132B has a shape having a width narrower than the main body portion 131B and the leading end portion 133B is provided to a leading end of the attaching portion 132B. The leading end portion 133B has the same width as the attaching portion 132B and protrudes at right in an opposite direction to the center direction of the housing 11.

In other words, as shown in FIG. 5(A), a leading end portion 133A of the support column 13A protrudes from the center of the housing 11 to the front direction (+Z direction) of the apparatus. In addition, the leading end portion 133B of the support column 13B protrudes from the center of the housing 11 to the right rear direction (+X, −Z direction) of the apparatus and a leading end portion 133C of the support column 13C protrudes from the center of the housing 11 to the left rear direction (−X, −Z direction) of the apparatus.

Next, the shape of the frame 4 is described with reference to FIG. 6. FIG. 6 shows an outward appearance of the frame. FIG. 6(A) is a perspective view of the frame and FIG. 6(B) is a partial enlarged view of the frame.

As shown in FIG. 6(A), the frame 4 is provided with the microphone frames 14A, 14B, 14C whose cylindrical opening portions (surfaces that are not circumferential surfaces of the microphone frames) are directed toward the center of the frame 4 when seen from top surface. Specifically, the cylindrical opening portion of the microphone frame 14A faces the front direction (+Z direction) and the rear direction (−Z direction) of the apparatus. The cylindrical opening portion of the microphone frame 14B faces the right rear direction (+X, −Z direction) and the left front direction (−X, +Z direction) of the apparatus and the cylindrical opening portion of the microphone frame 14C faces the left rear direction (−X, −Z direction) and the right front direction (+X, +Z direction) of the apparatus. By this configuration, the frame 4 is formed so that directional axes of unidirectional microphones fitted in the microphone frames 14A, 14B, 14C are crossed at the central point of the frame 4.

Next, the shape of the microphone frames 14A, 14B, 14C is described. Since the microphone frames 14A, 14B, 14C have the same shape, the microphone frame 14B is exemplified in the below. When seen from the top surface of the frame 4, the microphone frame 14B is provided with the joint part 141B at an opposite position to the center of the frame 4 (i.e., the outermost position of the frame 4). At this time, the joint part 141B is arranged at a downward end (i.e., the lowest position with respect to the frame 4) when seen from the side direction of the frame 4. In the meantime, although the joint part 141B is provided at the outer circumferential surface of the microphone frame 14B, the joint part 141B may be provided on a bottom surface of the microphone frame 14B.

As shown in FIG. 6(B), the joint part 141B has a T shape and includes a shaft portion 142B having a cylindrical shape and an attaching portion 143B having a cylindrical shape and a length longer than the shaft portion 142B. The shaft portion 142B extends perpendicularly to the cylindrical opening surface of the microphone frame 14B and the attaching portion 143B is mounted to a leading end of the shaft portion 142B. At this time, the attaching portion 143B is formed so that the leading end of the shaft portion 142B is connected to a longitudinally central position of the attaching portion 143B. In addition, the attaching portion 143B is perpendicular to the shaft portion 142B and is parallel with a plane (XZ plane) on which the microphone frames 14A, 14B, 14C are arranged.

Next, the shape of the elastic rubbers 15A, 15B, 15C is described with reference to FIG. 7. FIG. 7 shows an outward appearance of the elastic rubber. FIG. 7(A) is a plan view and FIG. 7(B) is a perspective view. Since the elastic rubbers 15A, 15B, 15C have the same shape, the elastic rubber 15A is exemplified in the below.

Figure 7:
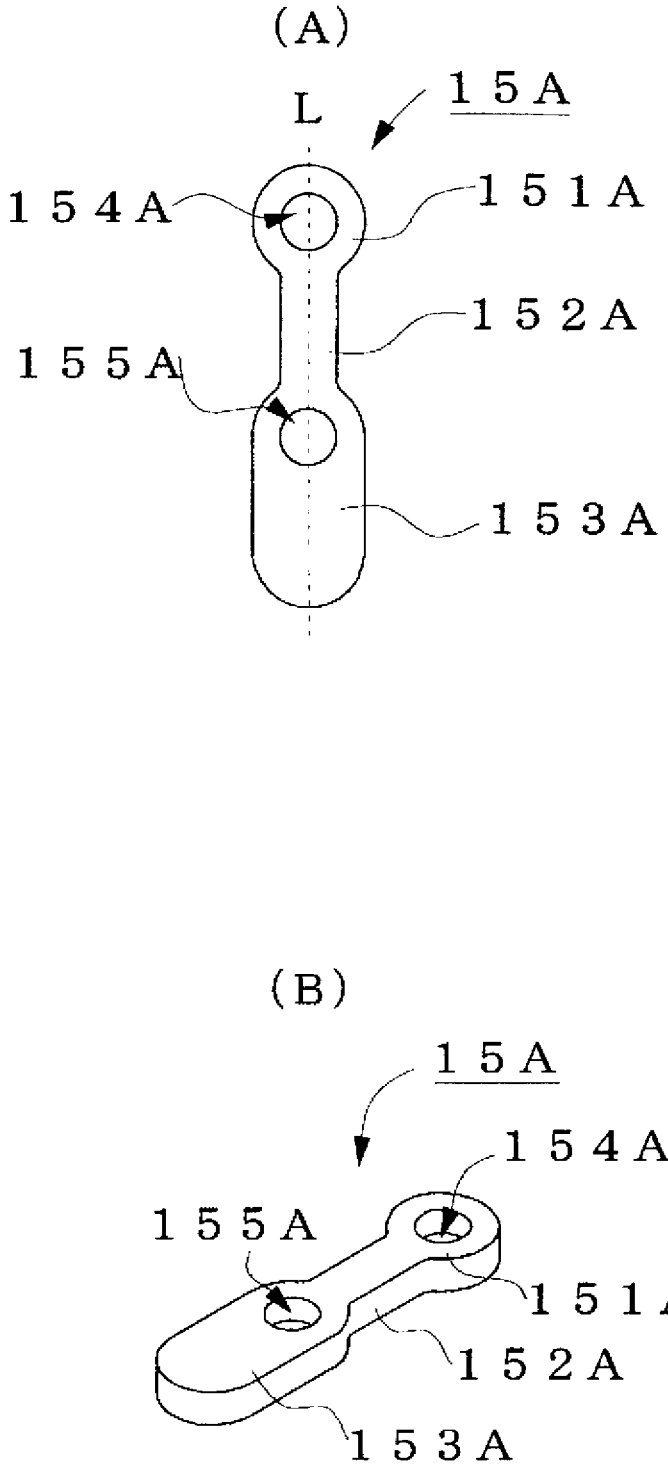
FIG. 7(A) is a view showing an outward appearance of an elastic rubber and FIG. 7(B) is a perspective view showing an outward appearance of the elastic rubber.

As shown in FIG. 7, the elastic rubber 15A has a flat plate shape. When seen from a plan view, the elastic rubber has a circular head portion 151A, a rectangular neck portion 152A and a corner-rounded rectangular main body portion 153A along a longitudinal direction thereof. A diameter of the head portion 151A is greater than a widthwise length of the neck portion 152A and the same as a widthwise length of the main body portion 153A. In addition, a longitudinal direction of the main body portion 153A and a longitudinal direction of the neck portion 152A are coincident with each other.

The head portion 151A is formed with a circular opening 154A that penetrates the flat plate and has the same center as that of the hear portion 151A. Likewise, the main body portion 153A is formed with a circular opening 155A at one end thereof in longitudinal direction near the neck portion 152A. The opening 154A and the opening 155A have the same diameter and are formed so that the respective centers thereof are arranged in a line L.

Figure 8:
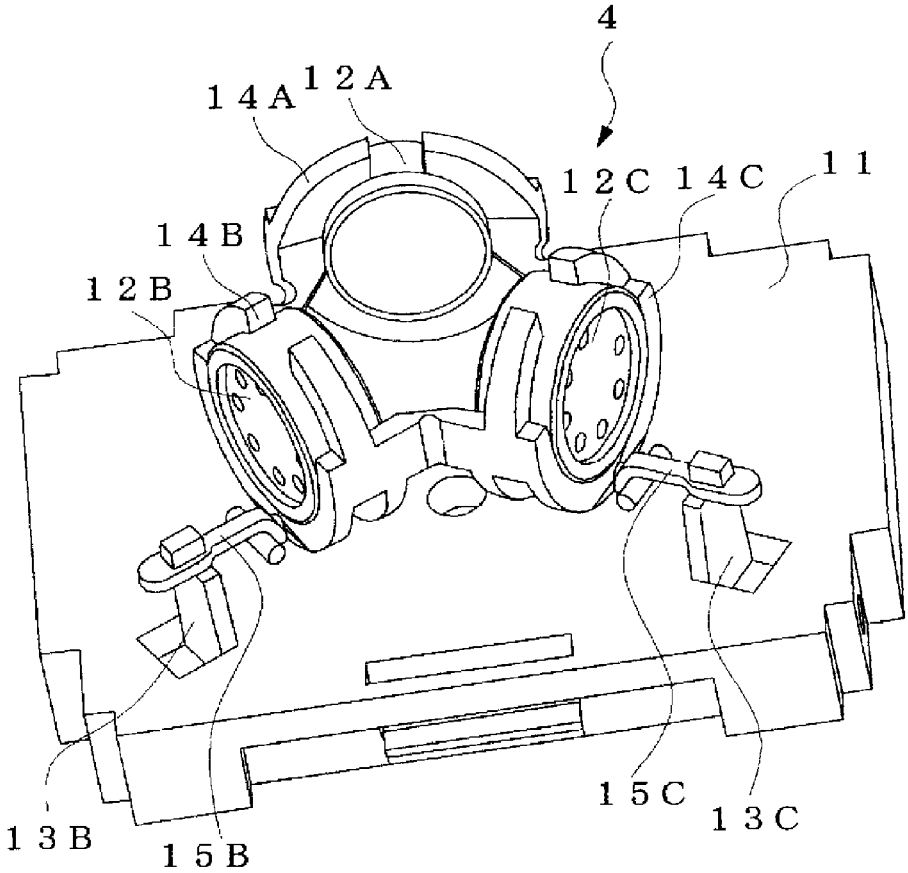
FIG. 8 illustrates a frame attaching method.

Next, a method of attaching the frame 4 to the housing 11 is described with reference to FIGS. 4 and 8. FIG. 8 is a perspective view for illustrating the method of attaching the frame 4 to the housing 11.

First, the microphones 12A, 12B, 12C are respectively attached to the microphone frames 14A, 14B, 14C. In this embodiment, as shown in the plan view of FIG. 4, the microphone 12A is fitted in the microphone frame 14A so that a direction of maximizing sensitivity (maximum sensitivity direction) of the unidirectional microphone 12A faces toward the rear direction (−Z direction) of the apparatus. The maximum sensitivity direction of the microphone 12A is directed to zero degree. In addition, the microphone 12B is fitted in the microphone frame 14B so that a direction of maximizing sensitivity of the unidirectional microphone 12B faces toward the left front direction (−X, +Z direction) of the apparatus. In other words, when seen from the top surface of the frame 4, the microphone 12B is fitted to face an angle of left 120 degrees (a direction of +120 degrees) from the zero degree. In addition, the microphone 12C is fitted in the microphone frame 14C so that a maximum sensitivity direction of the unidirectional microphone 12C faces toward the right front direction (+X, +Z direction) of the apparatus. In other words, when seen from the top surface of the frame 4, the microphone 12C is fitted to face an angle of right 120 degrees (a direction of −120 or +240 degrees) from the zero degree.

Then, as shown in FIG. 8, the elastic rubbers 15A, 15B, 15C are respectively attached to the joint parts 141A, 141B, 141C of the frame 4. For example, one end of the attaching portion 143B of the joint part 141B is enabled to pass through the opening 154B of the head portion 151B of the elastic rubber 15B and the opening 154B is then enlarged to enable the other end of the attaching portion 143B to pass therethrough, so that the head portion 151B of the elastic rubber 15B is attached to the shaft portion 142B. At this time, when seen from the top surface of the frame 4, the elastic rubber 15B is attached so that the elastic rubber 15B becomes a top surface of the attaching portion 143B of the joint part 141B. Like this, the respective elastic rubbers are attached to pass the upper sides of the respective joint parts, so that the frame 4 can be more stably mounted to the housing 11, compared to a configuration where the respective elastic rubbers are attached to pass the lower sides of the respective joint parts.

Then, the elastic rubbers 15A, 15B, 15C are respectively attached to the support columns 13A, 13B, 13C of the housing 11. Specifically, when seen from the top surface, the frame 4 is arranged above the top surface of the housing 11 so that the center of the frame 4 is consistent with the center of the housing 11. Then, for example, by extending the main body portion 153B of the elastic rubber 15B, the leading end portion 133B of the support column 13B is enabled to pass through the opening 155B of the main body portion 153B, so that the elastic rubber is attached to the attaching portion 132B.

Like this, when seen from the plan view of the sound pickup apparatus 1, the frame 4 is arranged in the region surrounded by the support columns 13A, 13B, 13C provided to the housing 11 so that the center of the frame 4 is consistent with the center of the housing 11. In addition, the frame 4 is arranged above the housing 11 so that the joint parts 141A, 141B, 141C are arranged on the lines extending from the center of the housing 11 to the support columns 13A, 13B, 13C and between the center of the housing 11 and the respective support columns. The frame 4 is attached to the housing 11 in a state where tensile stresses are generated in the elastic rubbers 15A, 15B, 15C. The directions of the tensile stresses of the elastic rubbers 15A, 15B, 15C and the directions perpendicular to the vibration planes of the nearest microphones 12A, 12B, 12C corresponding to the respective elastic rubbers 15A, 15B, 15C are the same when seen from the plan view (when seeing the plane formed by the +X and +Z axes from the +Y direction in FIG. 4).

By this structure, as described above, since the frame 4 is pulled by the same force in the three directions (directions facing the support columns 13A, 13B, 13C from the center of the housing 11) that are spaced apart from each other at an equal angle distance from the center of the frame 4, which is a standard point, by the support columns 13A, 13B, 13C and the elastic rubbers 15A, 15B, 15C, the frame is arranged so as to be floated at a specific position above the top surface of the housing 11. At this time, since the heights at which the support columns 13A, 13B, 13C and the elastic rubbers 15A, 15B, 15C are engaged are the same, the joint parts 141A, 141B, 141C are arranged on a same face. Thereby, the bottom surface of the frame 4 is parallel with the top surface of the housing 11.

Accordingly, since the three microphones fitted in the microphone frames are mounted above the top surface of the housing 11 so that the three microphones are not translation-moved or rotated, the axial directions of the sound pickup directionality are not shaken. Here, the configuration that the three microphones are not translation-moved means that since the frame 4 is not moved in parallel with the top surface of the housing 11, the three microphones fixed by the frame 4 are not also moved in parallel with the top surface of the housing 11. As a result, the sound pickup apparatus can fix the three microphones with a simple structure and the small number of parts (frame, three support columns and three elastic rubbers) without deteriorating the sound pickup performance.

In the above structure, since the frame 4 is attached to the support columns by the elastic rubbers in a state where the tensile stress is generated in the elastic rubbers, the three microphones, which are integrally fixed to the frame 4, are swingably mounted (so as to be floated) without being fixed to the housing 11. Thereby, since the vibration of the housing 11 is attenuated by the elastic rubbers 15A, 15B, 15C, the three microphones can suppress the sound pickup noise and the like of the microphones due to the vibration of the housing 11.

In the above structure, the unidirectional microphones 12A, 12B, 12C are arranged on the one plane (plane that is parallel with the top surface of the housing). The maximum sensitivity directions of the respective unidirectional microphones are directed toward the inward direction of the arrangement. In other words, the respective unidirectional microphones are inwards arranged on the circumference about the point at which the directional axes are crossed. Like this, the maximum sensitivity directions of the respective microphones are directed toward the inward direction of the arrangement, so that it is possible to arrange the vibration plane more closely, compared to a configuration where the maximum sensitivity directions are directed toward the outward direction. As a result, it is possible to approximate the positions of the vibration plane of the respective unidirectional microphones at the point at which the directional axes are crossed. Accordingly, it is possible to control the directionality on the plane with a small error even at the high frequency band such as 1 kHz or higher.

Figure 9:
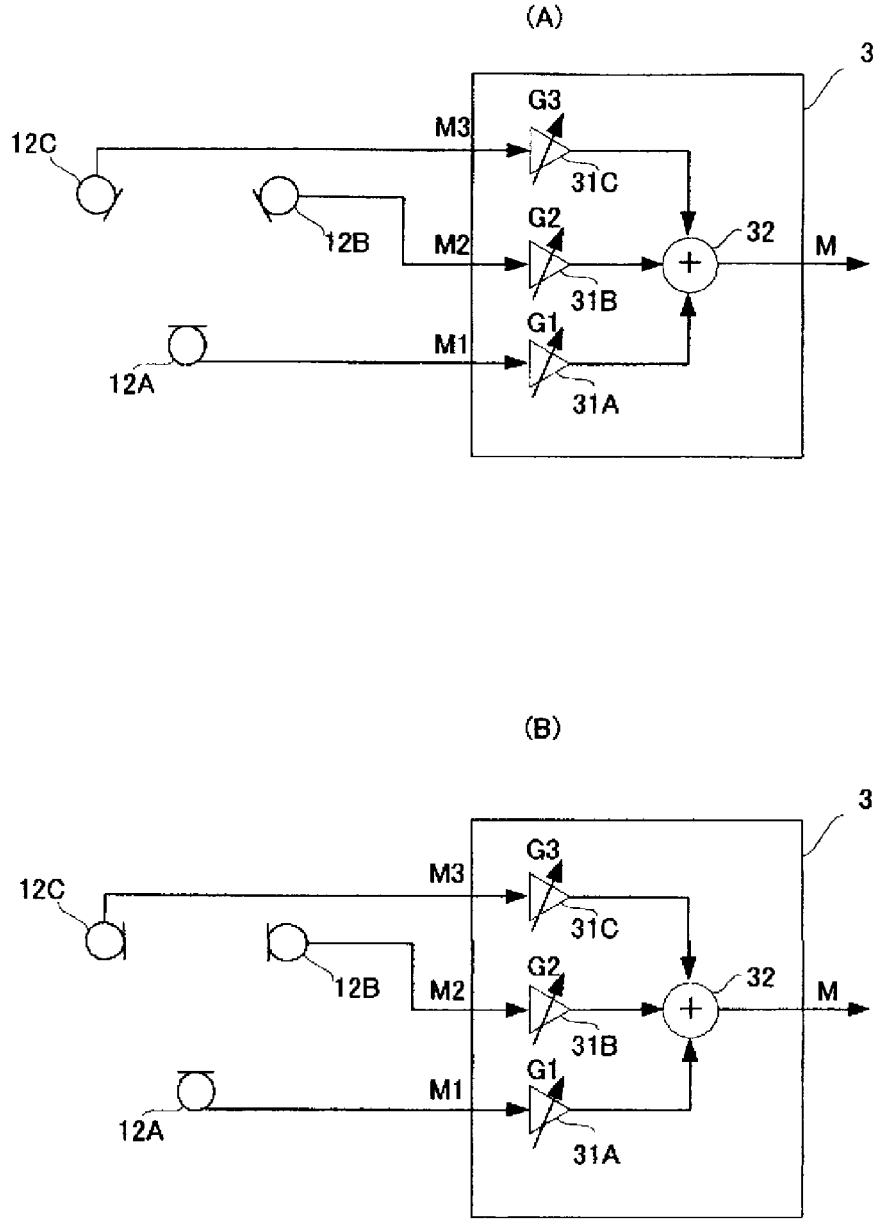
FIG. 9(A) is a block diagram showing a configuration of a sound signal processing system of the sound pickup apparatus and FIG. 9(B) is a block diagram showing a configuration of the sound signal processing system of the sound pickup apparatus.

In the meantime, the sound pickup apparatus having the above structure controls the sound pickup directionality by a following method. The directionality control of the sound pickup apparatus 1 is described with reference to FIGS. 9 and 10. FIG. 9(A) is a block diagram showing a configuration of a sound signal processing system of the sound pickup apparatus.

As shown in FIG. 9(A), the sound pickup apparatus 1 has, as a configuration of a signal processing system, a signal processing unit 3 including a gain adjustor 31A, a gain adjustor 31B, a gain adjustor 31C and an adder 32. Sound signals that are output from the respective unidirectional microphones are adjusted in gain at the respective gain adjustors and are then added at the adder 32. The sound pickup apparatus 1 controls gains of the respective gain adjustors, thereby forming any directionality around the apparatus.

In the meantime, the arrangement of the respective unidirectional microphones is not limited to the above example. For example, an arrangement as shown in FIG. 9(B) may be possible. FIG. 9(B) shows an example in which the unidirectional microphone 12B and the unidirectional microphone 12C are opposed to each other. In this case, the maximum sensitivity direction of the unidirectional microphone 12B is a left plane direction of the apparatus (a direction of $\theta=90°$) and the maximum sensitivity direction of the unidirectional microphone 12C is a right plane direction of the apparatus (a direction of $\theta=-90°$). Like this, even when the unidirectional microphone 12B and the unidirectional microphone 12B are opposed to each other, it is possible to form the directionality of the microphones in an arbitrary direction.

As described above, when the three or more unidirectional microphones are arranged on the one plane, any arrangement can realize the sound pickup apparatus of the invention.

In the above embodiment, the example in which the three microphones are arranged on the same plane has been described. However, a plurality of additional microphones may be arranged on the same plane. In addition, the unidirectional microphones may be provided in a direction perpendicular to the same plane.

In the embodiment, the three support columns are provided. However, when three or more support columns are provided, the number of support columns is not limited. In addition, since the respective support columns are connected to the joint parts of the microphone frames, the support columns are provided depending on the number of microphones. The support columns are provided for each of the joint parts of the microphone frames, so that it is possible to minimize the vibration transmitted to the microphones.

In the above embodiment, the sound pickup apparatus in which the microphones are provided above the top surface of the flat plate-type housing 11 has been described. However, a sound emission and pickup apparatus in which the housing 11 has therein a speaker and the housing 11 functions as a speaker enclosure may be also possible. In this case, since the microphones are not influenced by vibration of the speaker due to sound emission, it is possible to suppress not only the vibration, which can influence the housing 11 from the outside, but also the vibration resulting from the sound emission of the speaker from spreading to the microphones, thereby preventing echoes from being generated.

In the above embodiment, when seen from the plan view of the frame 4, the respective elastic rubbers are attached so that the respective elastic rubbers are arranged above the joint parts. However, the respective elastic rubbers may be attached so that the respective elastic rubbers are arranged below the joint parts.

In addition, the coupling between the support columns and the joint parts is not limited to the elastic rubbers. For example, an elastic member such as plate spring may be used.

The operational effects of the sound pickup apparatus of the invention are described as follows.

According to the sound pickup apparatus of the invention, the frame that fixes the plurality of microphones is attached to the housing. The frame is arranged at the center of the housing and the plurality of support parts are mounted around the frame. In addition, since the sound pickup apparatus uses the elastic members to couple the frame with the respective support parts, the frame is swingably mounted (so as to be floated) with being spaced from the housing, without being fixed to the housing. Specifically, the frame has the plurality of microphone frames that fixes the microphones, respectively. At this time, the respective microphone frames fix the microphones so that the directional axes of the respective microphones are not consistent and are arranged on the one plane. The sound pickup apparatus may have a configuration in which the joint parts are provided to the respective microphone frames and the elastic members are respectively attached to the joint parts. In the meantime, the joint parts may be mounted to parts of the frame except for the microphone frames.

Thereby, since the microphones mounted to the frame are fixed to the housing so that the microphones are not translation-moved or rotated, the axial directions of the sound pickup directionalities of the respective microphones are not shaken. As a result, the sound pickup apparatus can mount the plurality of microphones while floating the microphones with a simple structure, compared to the configuration in which the elastic member entirely surrounds the frame, and the small number of part, without deteriorating the sound pickup performance. In the meantime, the configuration in which the microphones are not translation-moved means that the microphones are not moved in parallel with the top surface of the housing.

In addition, the frame of the sound pickup apparatus of the invention may have such a configuration that the plurality of microphone frames and the joint parts are integrally formed.

If the frame of the sound pickup apparatus is configured by separately forming and assembling the parts such as microphone frames and joint parts, the separate vibrations are caused between the parts. However, according to the frame having the above configuration, since the respective parts are integrally formed, the vibrations are not caused. Accordingly, it is possible to minimize the vibration to the microphones.

In addition, the sound pickup apparatus of the invention may have such a configuration that an elastic member having a length shorter than a distance between the support part and the joint part under no load is used.

Thereby, in the sound pickup apparatus, since the support parts and the frame are attached in a state where the tensile stress is generated in the elastic member, the frame can be attached while applying the uniform tensile force thereto.

Although the invention has been described with reference to the specific embodiments, it is apparent to one skilled in the art that the embodiments can be variously changed and modified without departing from the scope or spirit of the invention.

The present application is based on Japanese Patent Application No. 2009-028609 filed on Feb. 10, 2009, the contents of which are incorporated herein by reference.

DESCRIPTIONS OF REFERENCE NUMERALS

1: sound pickup apparatus
11: housing
12A to 12C: unidirectional microphone
13A to 13C: support columns
4: frame
14A to 14C: microphone frame
141A to 141C: joint part
15A to 15C: elastic rubber
3: signal processing unit
31A to 31C: gain adjustor
32: adder

The invention claimed is:

1. A sound pickup apparatus comprising:
a housing;
a frame that fixes a plurality of unidirectional microphones each having a maximum sensitivity along a directional axis;
a plurality of support columns provided on the housing; and
a plurality of elastic members each connecting the frame to one of the plurality of support columns to suspend the frame spaced away from the housing,
wherein each of the plurality of elastic members applies a tensile stress to the frame and the one of the support columns so that directions of the tensile stresses applied by all of the elastic members are in a same plane, and
wherein a direction of the tensile stress applied by each of the plurality of elastic members is the same as the directional axis of one of the plurality of unidirectional microphones.

2. The sound pickup apparatus according to claim 1, wherein the frame has a plurality of microphone frames each fixing one of the plurality of unidirectional microphones so that the directional axes of the plurality of unidirectional microphones are different from each other and the plurality of unidirectional microphones are spaced apart from each other at an equal angle on a same circumference of a circle.

3. The sound pickup apparatus according to claim 1, wherein the frame includes a plurality of joint parts to which the plurality of elastic members are attached to.

4. The sound pickup apparatus according to claim 3, wherein the frame includes a plurality of microphone frames each provided with one of the joint parts.

5. The sound pickup apparatus according to claim 4, wherein:
the frame has a shape of rotational symmetry,
the joint parts are arranged spaced apart from each other at an equal angle on a circumference of a circle having a center on a central axis of the shape of rotational symmetry of the frame, and
the support columns are arranged at the same angle as the joint parts on a circumference of a circle having a center on a central axis of the shape of rotational symmetry of the frame and having a radius different from a radius of the circle in which the joint parts are arranged.

6. The sound pickup apparatus according to claim 4, wherein the plurality of microphone frames and the joint parts are integrally formed.

7. The sound pickup apparatus according to claim 3, wherein each of the plurality of elastic members under no load has a length that is shorter than a distance between one of the support columns and a corresponding one of the joint parts.

8. The sound pickup apparatus according to claim 1, wherein the frame fixes the plurality of unidirectional microphones so that the directional axes of the plurality of unidirectional microphones are directed in an inward direction of an arrangement of the plurality of unidirectional microphones.

9. The sound pickup apparatus according to claim 1, further comprising:

a speaker, wherein the housing is a speaker enclosure, and wherein the speaker is provided in the housing.

10. The sound pickup apparatus according to claim 3, wherein each of the plurality of support columns extends outward from the housing.

11. The sound pickup apparatus according to claim 1, wherein the plurality of elastic members suspend the frame so that the frame floats at a specific position above the housing.

12. The sound pickup apparatus according to claim 1, wherein the plurality of support columns are disposed to surround the frame.

13. The sound pickup apparatus according to claim 1, wherein the number of the plurality of unidirectional microphones is three.

14. The sound pickup apparatus according to claim 13, wherein:

the frame has a shape of rotational symmetry, and the frame is configured so that the three microphones are arranged spaced apart from each other at an equal angle on a circumference of a circle having a center on a central axis of the shape of rotational symmetry of the frame.

15. The sound pickup apparatus according to claim 1, wherein:

the frame has a rotational symmetry with a center, and the directions of the tensile forces pass the center of the frame.

* * * * *